US010518155B2

(12) United States Patent
Portnoff et al.

(10) Patent No.: US 10,518,155 B2
(45) Date of Patent: Dec. 31, 2019

(54) POOL GAME DEVICE, SYSTEM, AND METHOD

(71) Applicant: Darin Portnoff, Richmond Hill (CA)

(72) Inventors: Darin Portnoff, Richmond Hill (CA); Randall Portnoff, Richmond Hill (CA)

(73) Assignee: Darin Portnoff, Ontario (CA)

( * ) Notice: Subject to any disclaimer, the term of this patent is extended or adjusted under 35 U.S.C. 154(b) by 0 days.

(21) Appl. No.: 15/533,161

(22) PCT Filed: Dec. 9, 2015

(86) PCT No.: PCT/CA2015/051295
§ 371 (c)(1),
(2) Date: Jun. 5, 2017

(87) PCT Pub. No.: WO2016/090484
PCT Pub. Date: Jun. 16, 2016

(65) Prior Publication Data

US 2017/0361192 A1 Dec. 21, 2017

Related U.S. Application Data

(60) Provisional application No. 62/090,076, filed on Dec. 10, 2014.

(51) Int. Cl.
*A63H 23/00* (2006.01)
*A63B 69/12* (2006.01)
(Continued)

(52) U.S. Cl.
CPC ..... *A63B 69/12* (2013.01); *A63H 23/10* (2013.01); *A63B 2071/0694* (2013.01);
(Continued)

(58) Field of Classification Search
CPC ..... A63H 23/10; A63B 69/12
(Continued)

(56) References Cited

U.S. PATENT DOCUMENTS 3,863,568 A 2/1975 Frederick
3,864,562 A 2/1975 Hawkins
(Continued)

FOREIGN PATENT DOCUMENTS

CN 2372498 4/2000

OTHER PUBLICATIONS

Pool Prints Feet http://www.speedousa.com/begin-to-swim-pool-prints-feet/style-7570498 Apr. 12, 2015 Apr. 12, 2015).
(Continued)

*Primary Examiner* — Joseph B Baldori
(74) *Attorney, Agent, or Firm* — Eckert Seamans Cherin & Mellott, LLC

(57) ABSTRACT

A kit comprising at least 2 devices adapted to be easily attached by way of suction to one or more sides or a bottom of a swimming pool, each of the devices having a grab member adapted to be grabbed by a hand of a child player or an adult player, the devices adapted to be easily attached to a side or bottom of the pool. A game can be played with the devices after they are attached at separate points such that a player may grab a first device with one hand and then a second device with another hand, moving along said side or said bottom while remaining under water. The device comprises a housing having an upper grab member having a height, diameter, cross-section, shape, and surface configured to be grabbed by a hand of a child or an adult, an actuator member configured to move up and down within the upper grab member, a spring member within the upper grab member arranged and adapted to urge the actuator member in an upward direction, and a flexible disk shaped member adapted to engage a swimming pool side or bottom by suction. The device is waterproof and is designed to be engaged by suction by pressing a release button while the
(Continued)

flexible disk shaped member is pressed against an underwater pool surface.

16 Claims, 12 Drawing Sheets

(51) Int. Cl.
*A63H 23/10* (2006.01)
*A63B 71/06* (2006.01)

(52) U.S. Cl.
CPC ..... *A63B 2207/02* (2013.01); *A63B 2220/833* (2013.01); *A63B 2225/055* (2013.01)

(58) Field of Classification Search
USPC ..... 446/153, 177
See application file for complete search history.

(56) References Cited

U.S. PATENT DOCUMENTS 4,218,056 A 8/1980 Whitling
5,601,514 A 2/1997 Horn
6,154,929 A * 12/2000 Dwyer ..... B63B 17/00 16/422
6,176,815 B1 1/2001 Riera
6,896,228 B1 * 5/2005 Lu ..... A47K 3/003 211/105.1
6,932,306 B2 * 8/2005 Zou ..... F16B 45/00 248/205.5
7,066,434 B2 * 6/2006 Kwok ..... F16B 47/006 248/205.5
7,226,026 B2 6/2007 Lin
7,229,059 B1 6/2007 Hood
7,338,020 B2 * 3/2008 Magid ..... F16B 47/006 248/205.5
7,661,638 B2 * 2/2010 Yu ..... F16B 47/00 248/205.5
7,690,609 B2 * 4/2010 Akai ..... F16B 47/00 248/205.5
7,850,133 B2 * 12/2010 Carnevali ..... F16B 47/00 248/205.5
7,913,963 B2 * 3/2011 Cheng ..... B60R 11/02 248/205.5
8,157,713 B1 4/2012 Siskowic et al.
8,191,839 B2 * 6/2012 Fan ..... F16B 47/006 248/205.5
8,356,781 B2 * 1/2013 Chen ..... F16B 47/006 248/205.7
8,496,222 B2 * 7/2013 Li ..... F16B 47/006 248/205.5
9,199,696 B1 * 12/2015 Bonell ..... B63B 21/20
9,200,667 B1 * 12/2015 Hsu ..... F16M 13/02
9,664,227 B2 * 5/2017 Huang ..... F16B 47/006
2007/0213126 A1 * 9/2007 Deutsch ..... A63B 71/0686 463/36
2009/0221337 A1 * 9/2009 Tranum ..... A63H 33/00 463/7
2014/0228173 A1 * 8/2014 Shaw ..... A63B 71/0622 482/4

OTHER PUBLICATIONS

LED Dive Sticks http://www.hearthsong.com/set-of-3-led-light-show-dive-sticks.htm Apr. 13, 2012 (Apr. 13, 2012).
International Search Report of Corresponding International Application No. PCT/CA2015/051295, dated Feb. 10, 2016.
Written Opinion of Corresponding Internation Application No. PCT/CA2015/051295, dated Feb. 8, 2016.

* cited by examiner

POOL GAME DEVICE, SYSTEM, AND METHOD

CROSS-REFERENCE TO RELATED APPLICATIONS

This application is a national stage of PCT/CA2015/051295 which claims benefit of U.S. Provisional Application 62/090,076, filed Dec. 10, 2014, both of which are hereby incorporated by reference.

BACKGROUND

This invention relates to the field of exercise games, more particularly to apparatus for use in games to be played in swimming pools and to methods of playing the games.

Swimming pools are used by children and adults for recreation, most often for swimming, diving, cooling off, and in some cases for games which require equipment such as basketball nets which adhere to the sides of the pool, swimming training equipment, flotation devices, and elastic exercise devices which restrain a swimmer from moving in a forward direction when swimming.

Various devices have been proposed to enable pool exercise and game play, for example U.S. Pat. No. 6,176,815 to Riera discloses a swimming exercise and training apparatus having a flotation member sized and shaped to be positioned against a portion of a swimmer's upper torso with straps, cords, and suction cups arranged to retain the flotation member and therefore the swimmer in place in the pool while the person swims against resistance caused by the retention of the flotation member relative to the side of the pool.

U.S. Pat. No. 5,601,514 to Horn discloses another form of swimming exercise device which engages a side of a pool with suction cups which are on the ends of a rigid tubular member which is in turn connected to a harness to be worn by a swimmer who can swim against the resistance caused by being attached to the side of the pool through the harness, rod, and suction cups.

There are toys which comprise objects which can be thrown into a swimming pool designed to sink to the bottom and used in a game wherein swimmers compete to swim to the bottom of the pool and pick up the objects. Such games provide both entertainment and physical exercise.

There has been a long-felt need in this art for different game systems which allow swimmers to play underwater, compete with other swimmers, and which also provide entertainment and exercise.

SUMMARY OF THE INVENTION

It is an object of the present invention to provide apparatus for use in a novel swimming pool game which provides entertainment, exercise and in some cases can be used to provide improvement in swimming skills.

This object and others which will become apparent from the following disclosure and accompanying drawings are achieved by the present invention which comprises, in one aspect, a device comprising a housing having (A) an upper grab member having a height, diameter, cross-section, shape, and surface configured to be grabbed by a hand of a child or an adult, (B) an actuator member at least partially enclosed within the upper grab member (A), configured to move up and down within the upper grab member (A), (C) a spring member within the upper grab member (A) arranged and adapted to urge the actuator member (B) in an upward direction, (D) a lower portion, (E) a flexible disk shaped member within the lower portion (D), the flexible disk shaped member (E) secured along its circumference to the lower portion (D), the center of the flexible disk shaped member (E) engaged with the actuator member (B), (F) a lock member configured to lock the actuator member (B) in a down position against the resistance of the spring member (C), (G) a release member arranged to move the lock member (F) and release the actuator member (B), allowing the actuator member (B) and the center of the flexible disk shaped member (E) engaged with the actuator member (B) to move in an upward direction, the device adapted to cause the flexible disk member (E) to engage a flat surface of swimming pool by suction when the lock member (F) is released and the actuator member (B) is urged in an upward direction by spring member (C). Preferably the device is water-proof at water pressures of at least 20 feet and the device is able to continue operation after water has entered both the upper grab member (A) and lower portion (D).

In some embodiments the device includes one or more release tab(s) engaged with the flexible disk so that the suction caused by negative pressure can be broken and the device removed from the pool surface. In some embodiments the lower portion (D) has a circumference and has cross-section larger than the cross section of the upper grab member (A). In certain embodiments the flexible disk shaped member (E) has a circumference approximately the same as the circumference of the lower portion (D).

In another aspect, the invention comprises a kit which comprises at least 2 of the devices, either of the preferred design or an alternative design having the same function but not necessarily of the same configuration as the above-described device, adapted to be easily attached by way of suction to one or more sides or a bottom of a swimming pool, each of the devices having a grab member adapted to be grabbed by a hand of a child player or an adult player The grab member can be of any design but is preferably an elongated member extending away from the pool wall or floor such as a hollow or solid cylindrical section, Although U-shaped handles and handles of other shapes are possible designs for the grab member, they are less preferred unless designed so that neither bathing suit straps, clothing, jewelry, nor swimming accessories will become entangled with one of them and a small hand will not be caught in one of them, which might prevent a person from safely returning to the surface of the water.

In some embodiments one or more of the devices comprises one or more light emitting members to enhance night time play or allow play in low light conditions. In some embodiments one of more of the devices comprises a programmed member comprising a sensor and one or more light emitting members which either flash a signal if a device is grabbed within a predetermined time or if the devices are grabbed in a predetermined sequence.

Preferably the kit includes 2 to 20 devices and more preferably 6 to 10 devices. The most preferred kit embodiment comprises 8 devices.

The devices may, in some embodiments, include means to communicate with each other or with an external controller for certain game systems.

Several games and exercise routines can be played by attaching the devices to one or more sides of a pool and/or to a bottom of a pool by way of suction so that the devices are separated by a distance such that a player may grab a first device with one hand and then a second device with another hand, moving along said side or said bottom while remaining under water.

For example, players may compete with one or more other players with regard to the time the players can complete a course of each of the devices or the amount of time the players can remain underwater while holding the devices. Many other single player and multi-player games are possible.

The device may be engaged to a plastic, tile, plaster, pebble, quartz, cement or any other relatively flat surface of a swimming pool via suction. In some embodiments the device can be engaged by pressing the actuator member (B) in a downward direction so that the flexible disk shaped member (E) is relatively flat, allowing or causing the actuator member (B) to be locked in a downward position against the urging of the spring member (C), placing the flexible disk shaped member (E) flat against a surface of a swimming pool, and unlocking the actuator member (B) so that the spring member (C) urges the actuator member (B) and in turn the center of the flexible disk shaped member (E) in an upward direction, creating a negative pressure between the flexible disk shaped member (E) and the surface of the swimming pool and thereby engaging the device onto the surface.

BRIEF DESCRIPTION OF THE DRAWINGS

For a fuller understanding of the invention, reference should be had to the following detailed description, taken in connection with the accompanying drawings in which.

DETAILED DESCRIPTION

Figure 1:
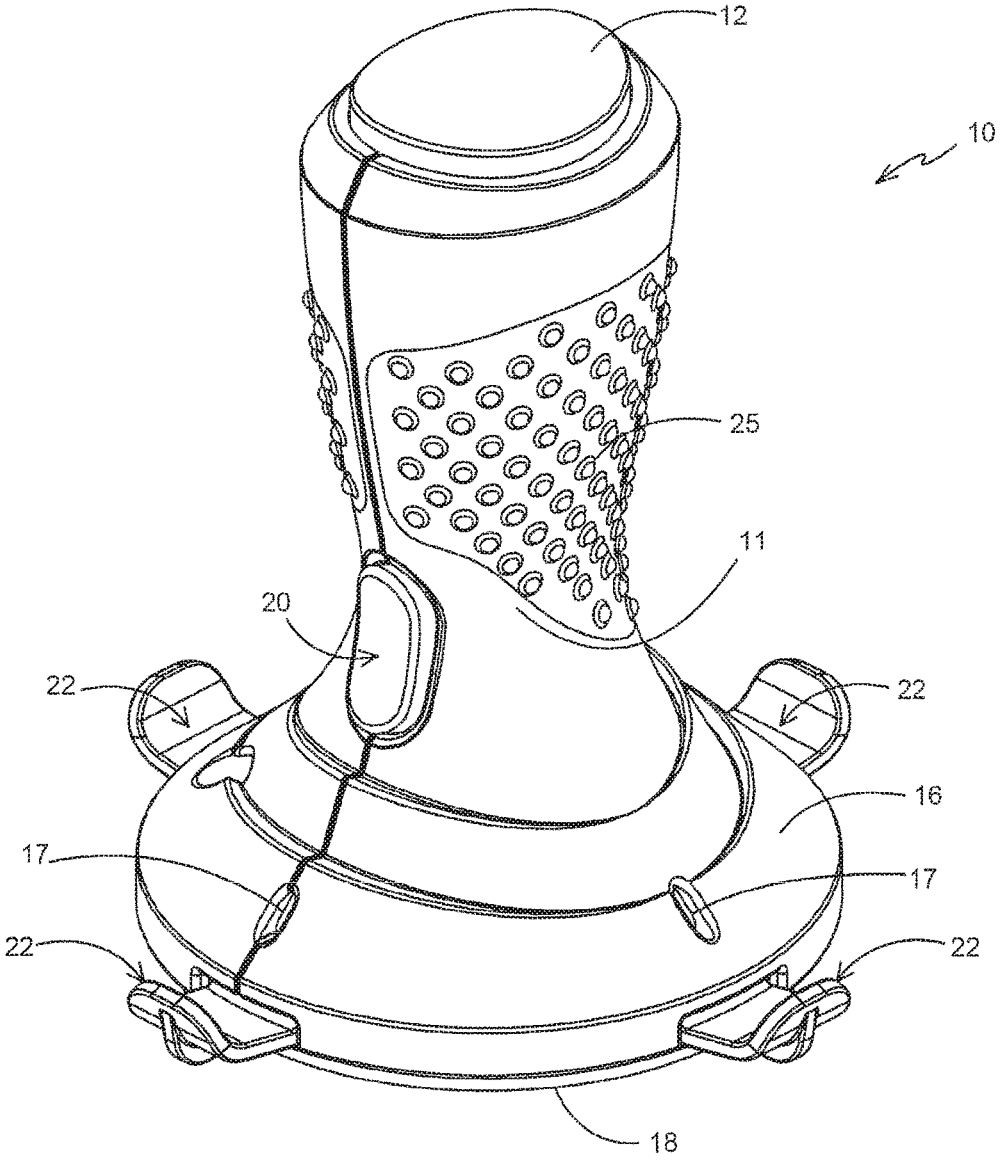
FIG. 1 is side perspective view of one embodiment of a device according to the invention.

The apparatus of the invention is designed to be used in a game to be played in swimming pools.

An example of a game which can be played with the apparatus comprises attaching a plurality of the devices to a relatively smooth surface of a swimming pool by use of suction so that the grab members which form grab bars are arranged approximately perpendicular to the surface of the pool. The surface to which the devices are attached should be relatively flat. The game consists of swimming underwater in the pool and pressing the release buttons to attach the devices to the bottom and/or sides of the pool.

Once the devices are attached via suction to the pool, the an exemplary game comprises a user grabbing each grab bar in sequence, hence "swinging" from one such device to the next, much like swinging on Monkey Bars in a playground, only under water and inverted.

There is no limit to the number of devices that may be used to play the game, although 2 to 20 devices would be most suitable. Preferably kits are arranged with a plurality of the devices. Preferably about 6 to 10 devices would be included in the kits.

The fun/challenge of the game is 1) in the process of arranging the devices on the pool surfaces which requires some creativity and imagination to design interesting configurations, 2) in the process of attaching the devices to the pool surfaces which requires some skill and breath control, and 3) the act of "swinging" from device to device under the water, as A) it allows the user to stay close to bottom of the pool longer than they otherwise would be able to absent a "handle" to hold on to, and B) the user gets the feeling of "flying" as they "swing" from one device to the next under water, and C) depending on how many devices have been attached to the pool and in what configuration (i.e., the length and configuration of the "course" they have set up), it can be a challenge to "complete the course" (i.e., if there are many devices in a course, the user may run out of breath, so it's a challenge to complete course as quickly as possible).

In addition to setting up a pre-configured course and attempting to navigate the course as described above, another way to play with the devices is simply to attach one or many to the pool bottom, and hold onto them in order to stay submerged, for example, to engage in other underwater activities without floating to the surface of the pool. Purely as one example, the user might hold onto one or more devices attached to the pool bottom in order to more easily pick up or play with other submerged toys (e.g., diving rings, etc.), or they might hold onto an device in order to stay submerged to more easily take an underwater photograph. There are many fun and useful activities for which a "handle" attached to the pool bottom may be useful.

As with any water toy that requires that the user hold their breath while playing with the toy under water (e.g., diving rings, etc.), another benefit is the safety and breath training that is inherent in the game. That is, the more time someone spends safely under water, the longer they are able to hold their breath and the more comfortable they are being submerged, the more confident they will be in the water and, therefore, they will be less likely to panic or run out of breath should a pool-related incident occur, e.g., falling in the water unexpectedly.

Each device may consist of a number of plastic, rubber and rust-proof metal parts, assembled to make a single, self-contained device incorporating the following main components: a suction providing member, a cylindrical handle which acts as a grab bar, and in preferred embodiments, an internal mechanism which includes a pre-load feature which allows suction to be provided when a spring actuated member is released.

The suction providing member is used to attach the device to the pool bottom, sides, or any flat surface. Theoretically the size can vary significantly, but in practical terms it will be between four (4) and six (6) inches in diameter. The suction providing member's surface will typically be constructed of soft rubber or similar material.

The upper grab member which forms a grab bar-like handle is the portion of the device that the user holds on to while playing the game.

In some embodiments, the handle is a solid or hollow vertical structure with no holes, loops or other protruding components that might cause the users hands, feet or other body parts, or clothing, to become caught or entangled in the device thereby trapping them underwater. The handle may be cylindrical or may be of any of a wide variety of shapes, for example a shape similar to a game joy stick, curved, loop-shaped, or any other shape suitable for grabbing by a child or adult under water when playing a game as described herein.

The suction providing member may be engaged with either a bottom, side wall, or any other flat/smooth surface of the pool by conventional means such as pressing the suction providing member toward the flat surface. In preferred embodiments, a mechanism is used to engage the suction cup, especially a "pre-load" mechanism so that the user can "prime" the suction of the device and then easily attach the device to the pool surface by disengaging, firing, or triggering the device to engage the suction cup.

In such preferred embodiments, the user may pre-load or "prime" a series of devices, usually about 6 to 10 but there is no limit to the number of devices used in a game, thereby having them ready to activate, and then enter the pool, place each device in the desired position, and then press a button or "trigger" to quickly and easily activate the suction cup to attach the device to the pool surface.

The suction providing member preferably has one or more easy release tab(s) and has a surface such that hair or string may be easily pulled out without significant force.

The device is designed so that it is impossible to engage the suction cup with any obstruction that is large or strong enough to prohibit the user from breaking the obstruction in order to safely return to the water surface, as the nature of a suction cup requires a dean and complete seal on the entire surface of the suction cup in order to operate. For example, a child's hair, swimming suit waste band or string, or piece of fabric, will always render the suction cup inoperable, thereby eliminating any risk.

The device should have a low or sleek profile which is absent of any openings or protrusions in which the user or their clothing may become entangled.

In some embodiments one or more of the devices comprises one or more light emitting members to enhance night time play or allow play in low light conditions. In some embodiments one of more of the devices comprises an electronic element which flashes a signal if the shaft is grabbed within a predetermined time or if the shafts are grabbed in a predetermined sequence or in the sequence within the time, e.g., 5 seconds to grab the next shaft. In some embodiments the shafts or devices communicate with each other or with a dry controller.

As described herein, the kits have preferably 2 to 20 devices, more preferably 6 to 10 devices, and the devices can have a wide variety of configurations.

One specific configuration of a device according to the invention is shown in FIG. 1 wherein the device 10 includes an upper grab member 11 having a height, diameter, cross-section, shape, and surface configured to be grabbed by a hand of a child or an adult, an actuator member 12 at least partially enclosed within the upper grab member 11, configured to move up and down within the upper grab member 11, a release button 20, tabs 22 which are used to break the suction between the device and a floor or wall of a swimming pool to which the device 10 has been secured, drainage holes 17, flexible disk 18, and textured grips 25.

Figure 2:
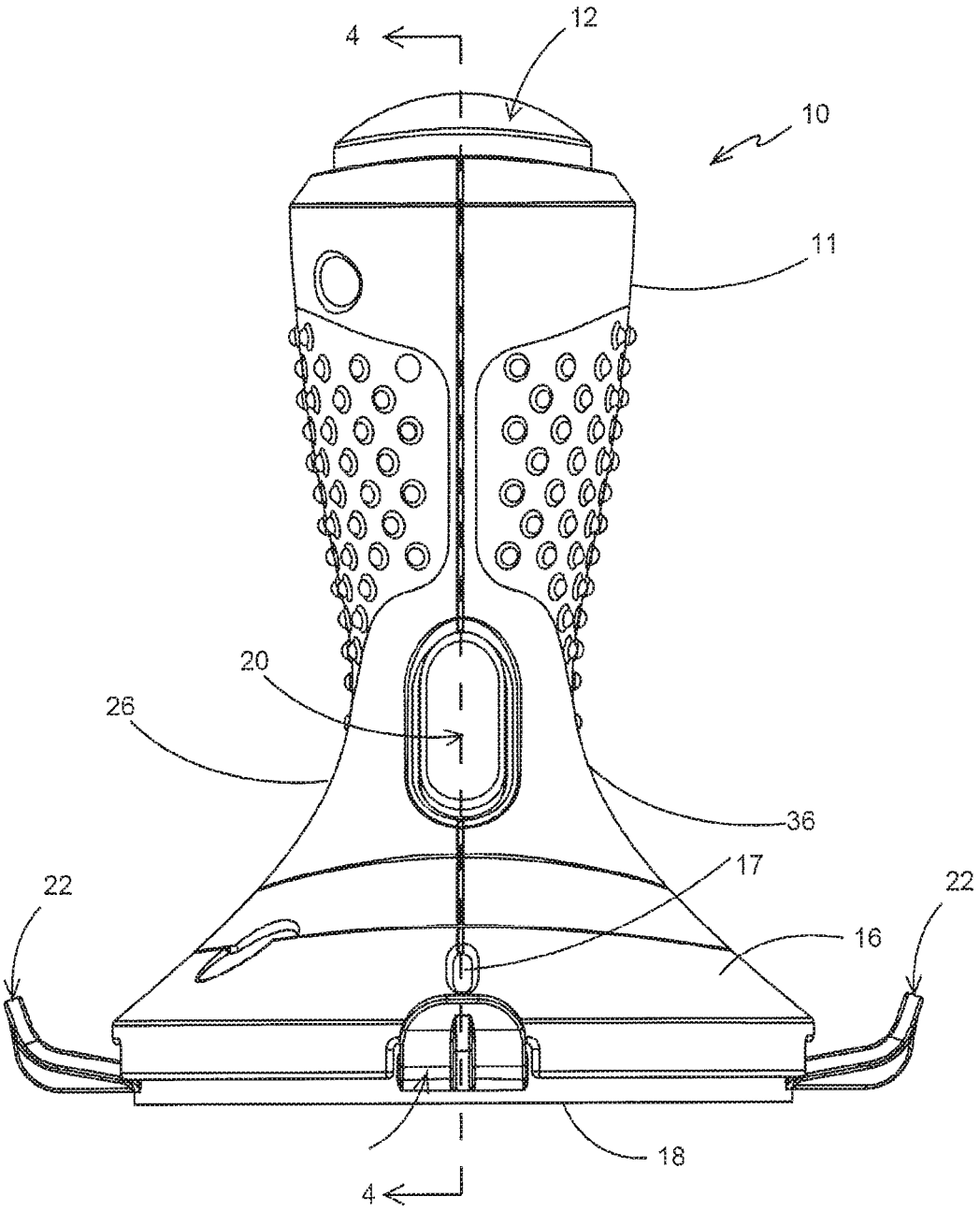
FIG. 2 is a front elevational view of the embodiment of the device shown in FIG. 1.

Referring now to FIG. 2, a front elevational view of device 10 includes the actuator member 12, release button 20, upper grab member 11, and lower housing 16 which includes drainage holes 17, tabs 22, and the flexible disk 18 as shown in FIG. 1. The device 10 is assembled by screwing a left housing side 26 to a right housing side 36.

Figure 3:
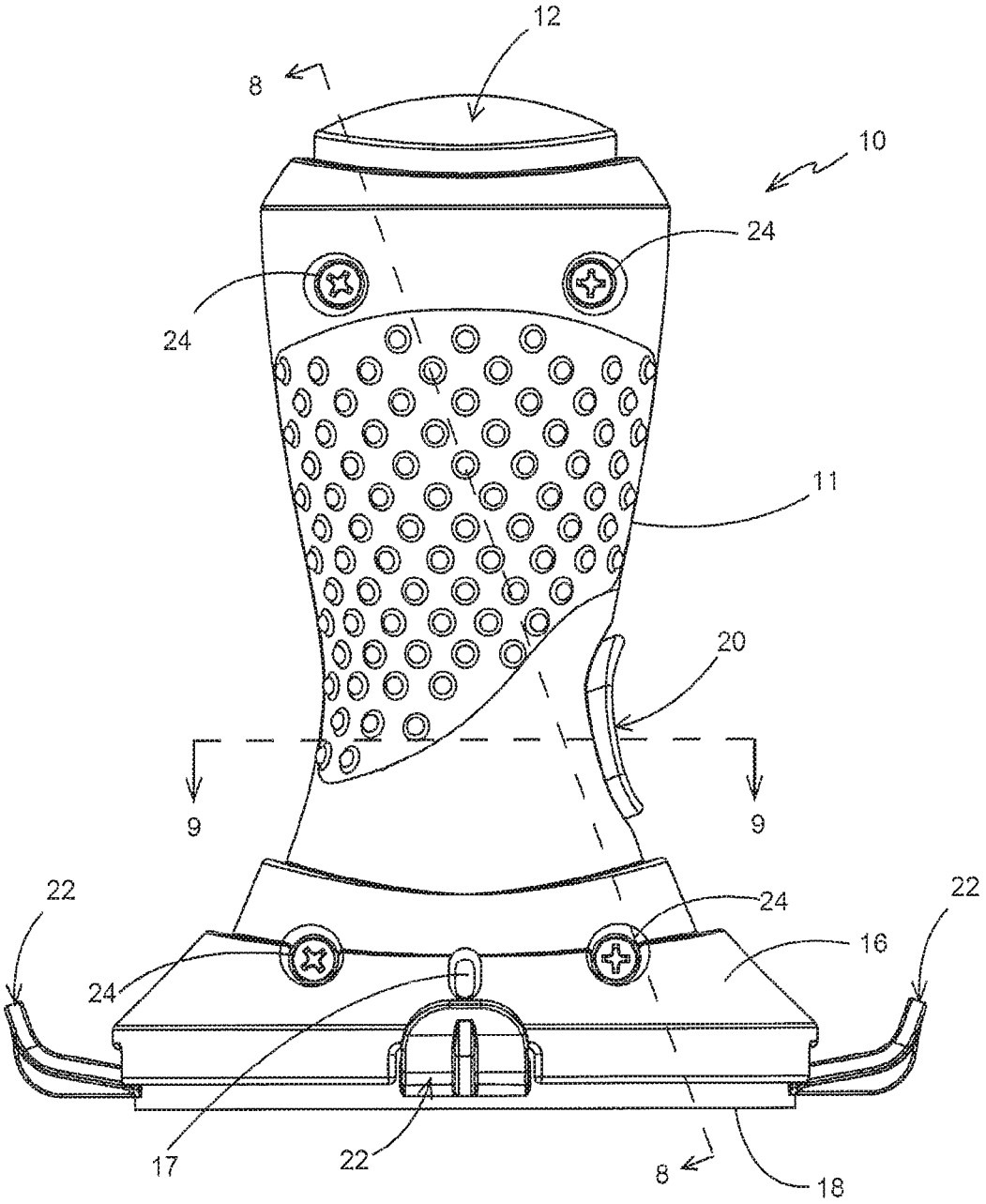
FIG. 3 is a side elevational view of the embodiment of the device shown in FIG. 1.

FIG. 3, a side elevational view of device 10, illustrates screws 24 which secure a left 26 and right 36 side of the device to each other. The left 26 and right 36 sides are illustrated in FIG. 2.

Figure 4:
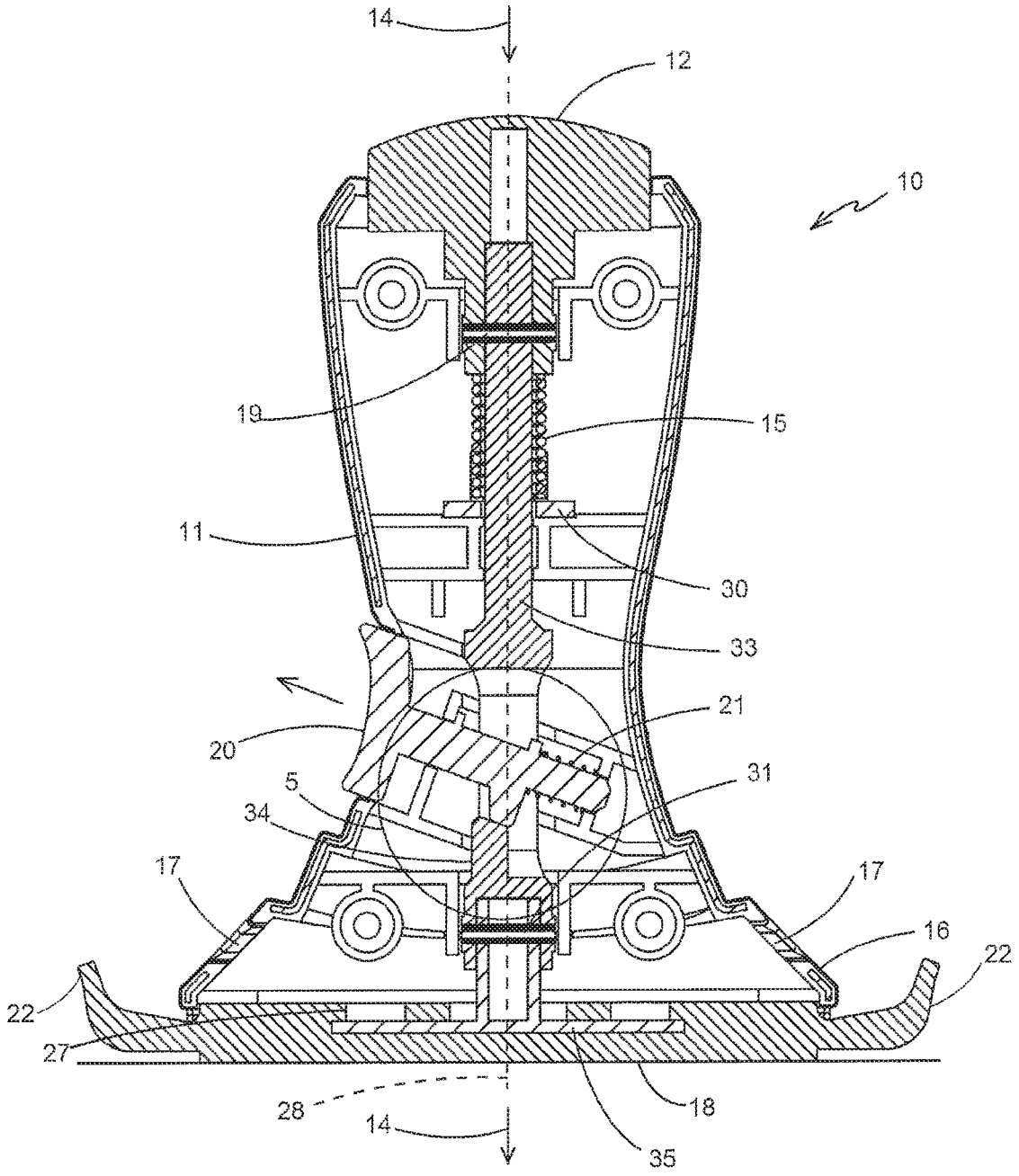
FIG. 4 is a cross-section through 4-4 of FIG. 2 in primed mode.

FIG. 4 is a cross-sectional view through 4-4 of FIG. 2 illustrating the device 10 in "primed" position in which actuator member 12 has been pressed down 14 which in turn presses upper shaft 33 down, which in turn presses lower shaft 34 down against resistance provided by spring 15 which in turn presses down on metal insert 35, which is embedded in flexible disk 18. Upper locking pin 19 locks actuator member 12 to upper shaft 33. Lower locking pin 31 locks metal insert 35 to lower shaft 34. Release button 20 is shown in its outward position which occurs when release button 20 is urged outwardly by release button spring 21 when actuator member 12 is depressed and upper shaft 33 is moved down 14 and locked in down position. Flexible disk 18 is flat in the primed position as a result of metal insert 35 being urged down by lower shaft 34 and upper shaft 33 and actuator member 12. The metal insert 35 is molded into flexible disk 18. The center 28 of the flexible disk 18 is aligned with the center of the metal insert 35 and upper shaft 33. The circle 5 in FIG. 4 is shown in FIG. 5 which is a magnified view of the lock portion within circle 5.

Figure 5:
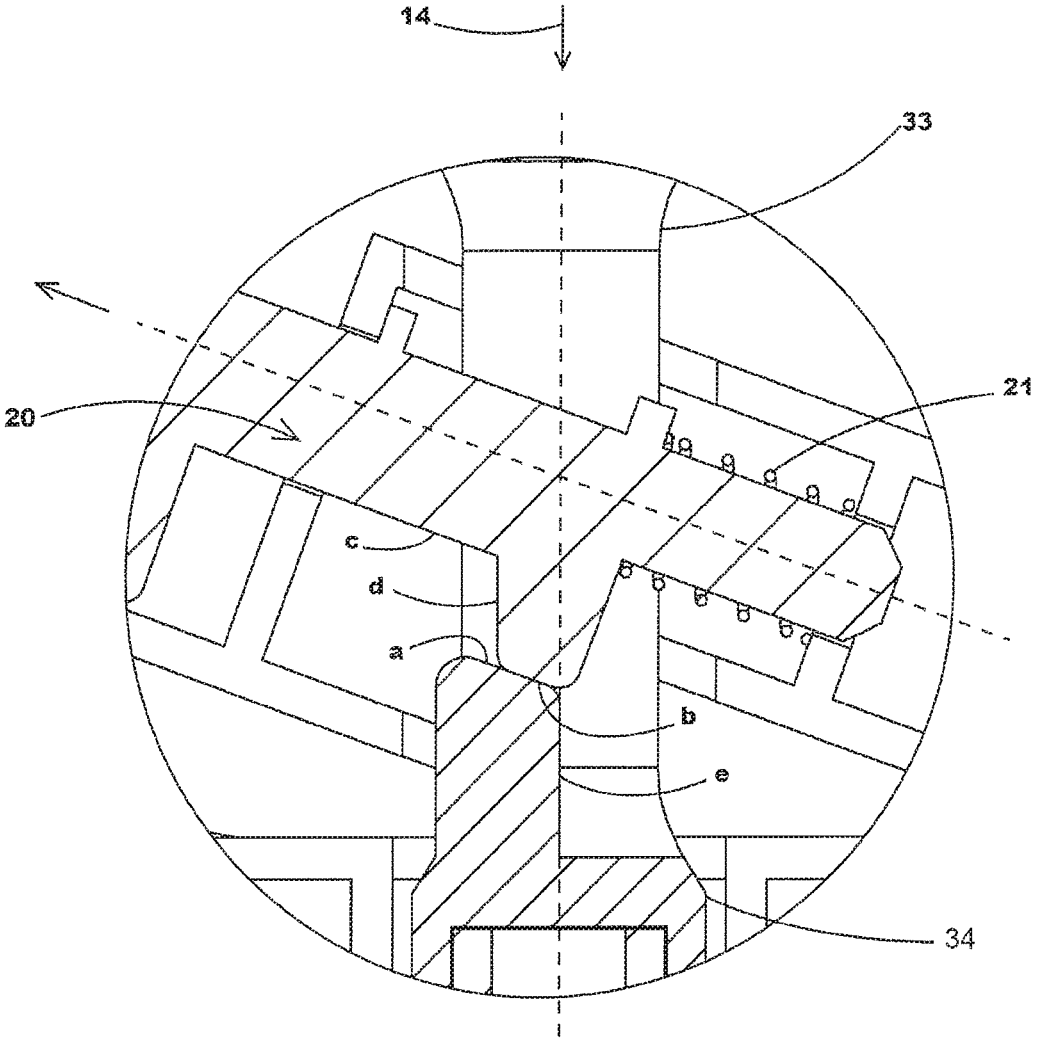
FIG. 5 is a magnified section of FIG. 4.

In FIG. 5, release button 20, upper shaft 33, lower shaft 34, and release button spring 21 are shown. In the primed mode, bottom surface b of protrusion d of release button 20 contacts surface a of upper shaft 33 to maintain upper shaft 33 in down position. As a result the upper shaft 33 is locked and ready to be released upon press of the release button 20.

Figure 6:
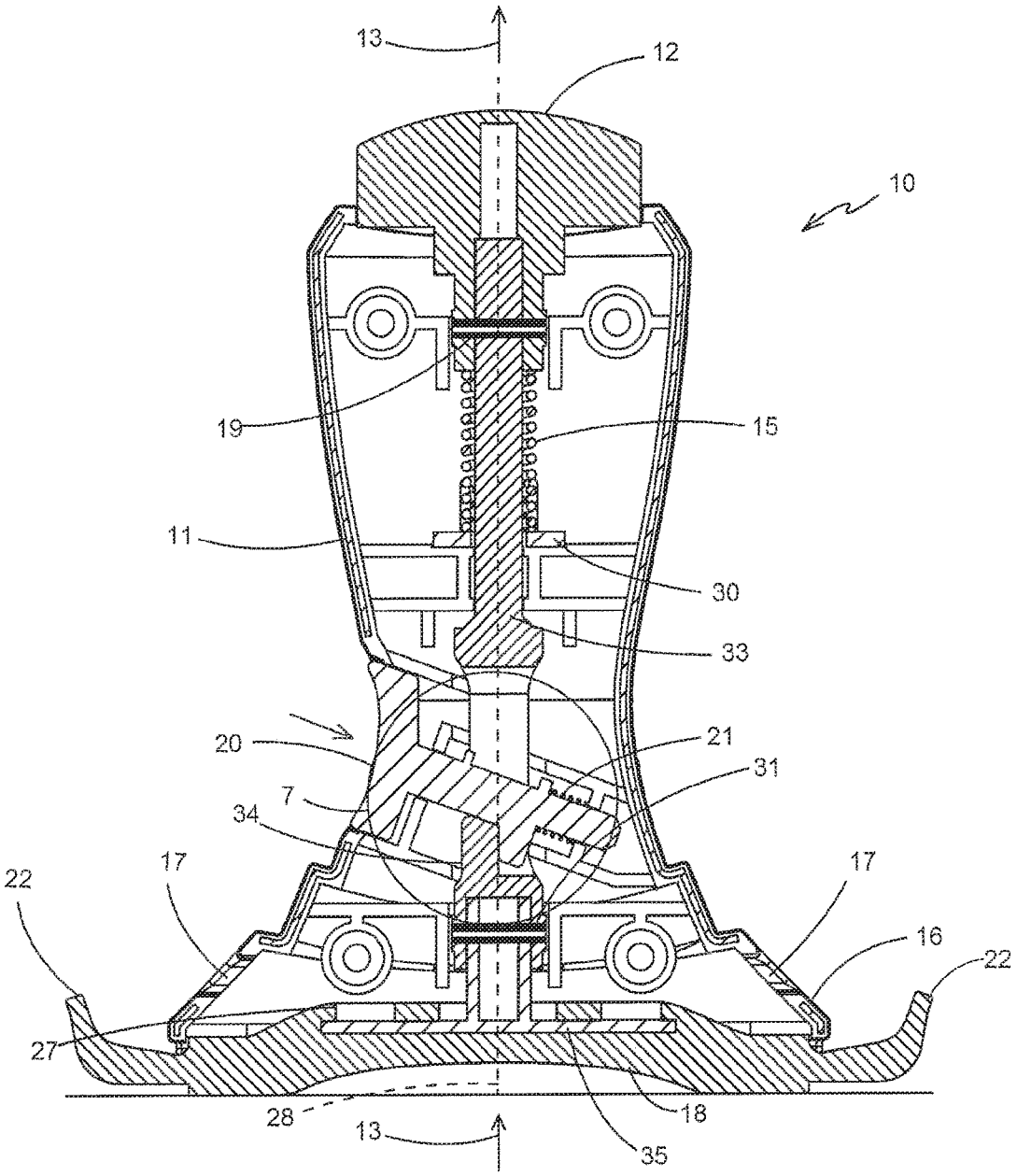
FIG. 6 is a cross-section through 4-4 of FIG. 2 in engaged mode.

FIG. 6 illustrates device 10 in "engaged" mode wherein release button 20 has been pressed inward against the resistance of release button spring 21 to unlock the upper shaft 33, allowing actuator member 12 to be pushed upward 13 by spring 15 which in turn moves upper shaft 33, lower shaft 34, metal insert 35, and the center of the flexible member 18 upward 13, causing a vacuum when the flexible disk 18 is placed against a smooth surface such as the bottom or side of a swimming pool. The fact that the device 10 is under water and the flexible disk 18 is wet allows a very strong suction to be achieved, thereby strongly securing the device to the side or bottom of the pool. The position of release button 20 and upper shaft 33 when the device is in engaged mode is shown in detail in FIG. 7 which is the circled portion 7 of FIG. 6.

Figure 7:
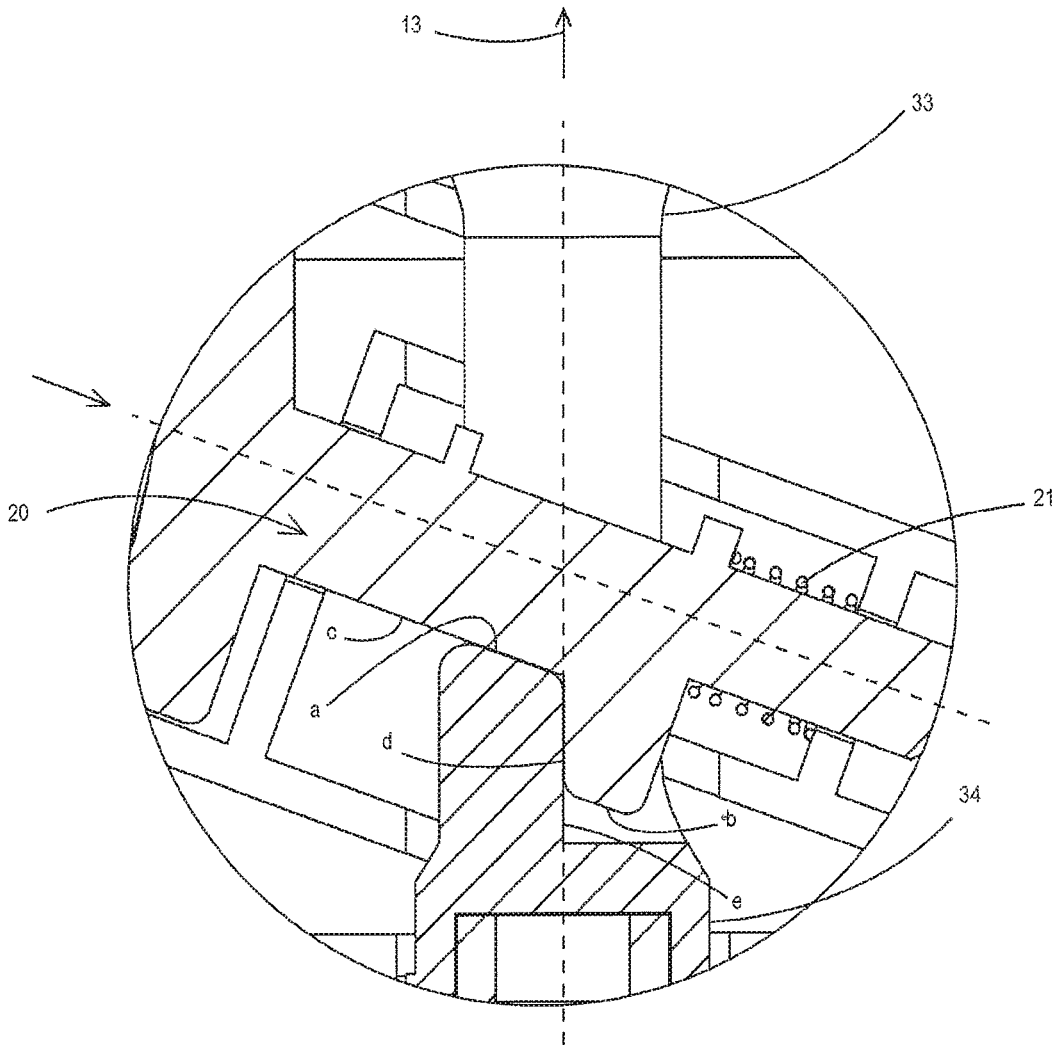
FIG. 7 is a magnified section of FIG. 6.

In FIG. 7 release button 20 in the pressed position, upper shaft 33 and lower shaft 34 in the up position, and release button spring 21 in the compressed position are shown.

Figure 8:
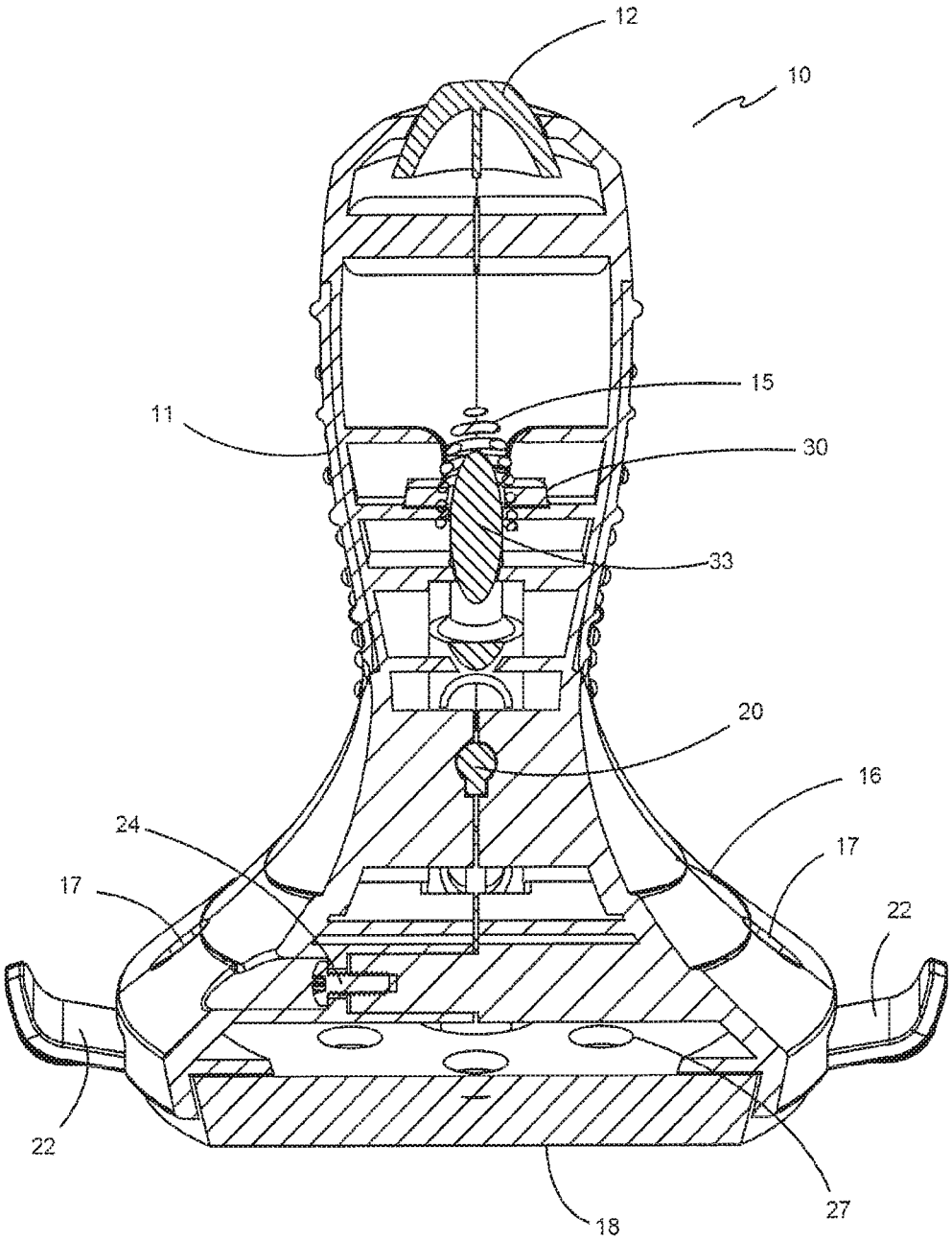
FIG. 8 is a cross-section through 8-8 of FIG. 3.

FIG. 8 is a cross-section through 8-8 of FIG. 3 showing flexible disk 18 in primed position.

Figure 9:
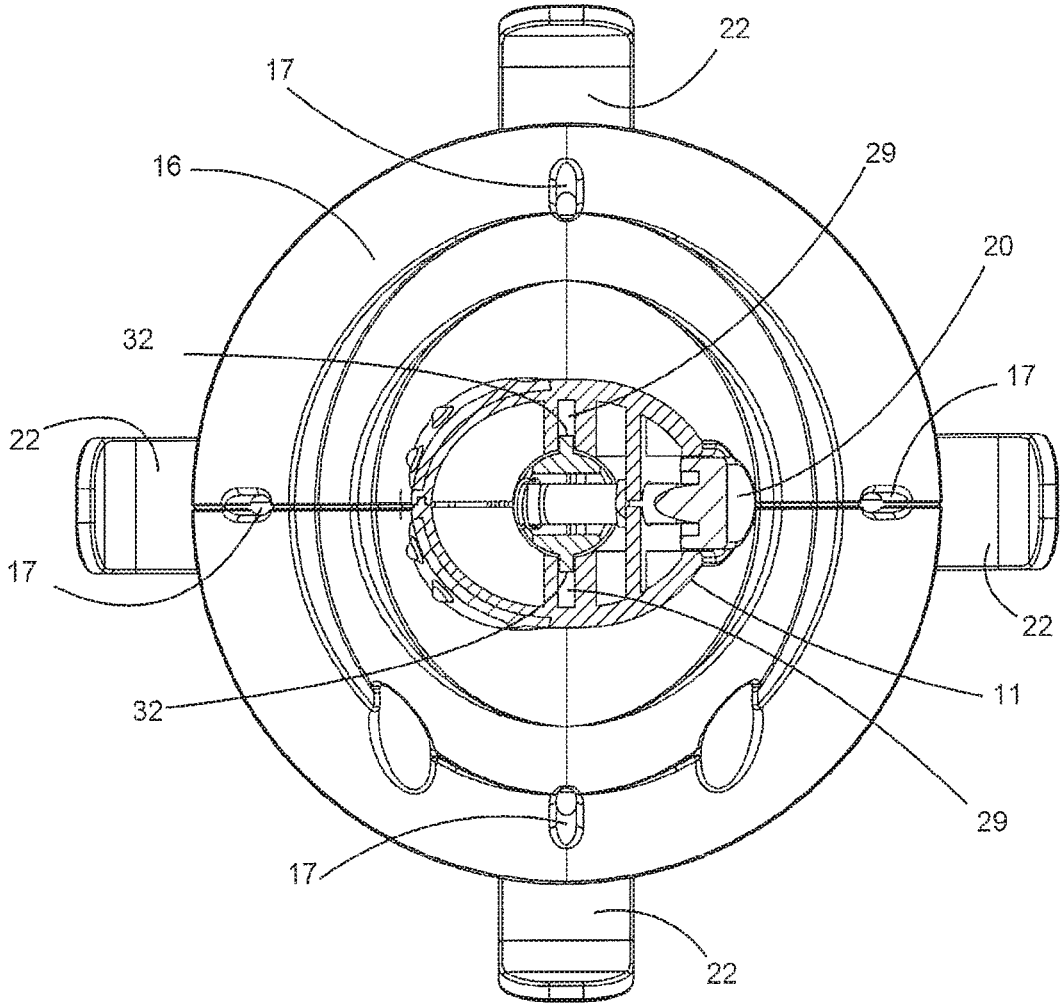
FIG. 9 is a cross-section through 9-9 of FIG. 3.
Figure 10:
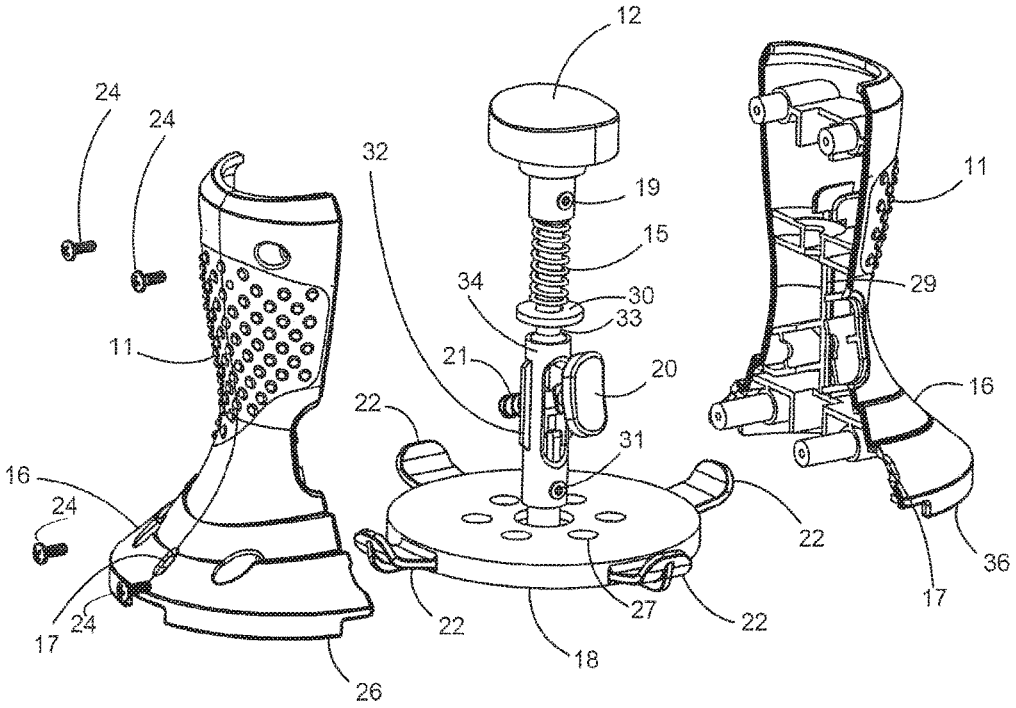
FIG. 10 is a breakaway perspective of device 10.

FIG. 9 is a cross-sectional view through 9-9 of FIG. 3 showing lower housing 16, release button 20, drainage holes 17, upper grab member 11, and tabs 22.

Lateral force may be applied to upper grab member 11. Because of the vacuum attaching flexible disk 18 to a smooth surface such as the bottom or side of a swimming pool, metal insert 35, which is embedded in flexible disk 18 remains in the down position, which in turn holds lower shaft 34 down against resistance provided by spring 15, allowing a gap between lower shaft 34 and upper shaft 33 to be created and allowing upper shaft 33 to remain in the up position, thereby avoiding release button spring 21 from urging button 20 into the outward position which would inadvertently prime the device thereby breaking the suction seal between flexible disk 18 and the smooth surface to which it is attached.

Figure 11:
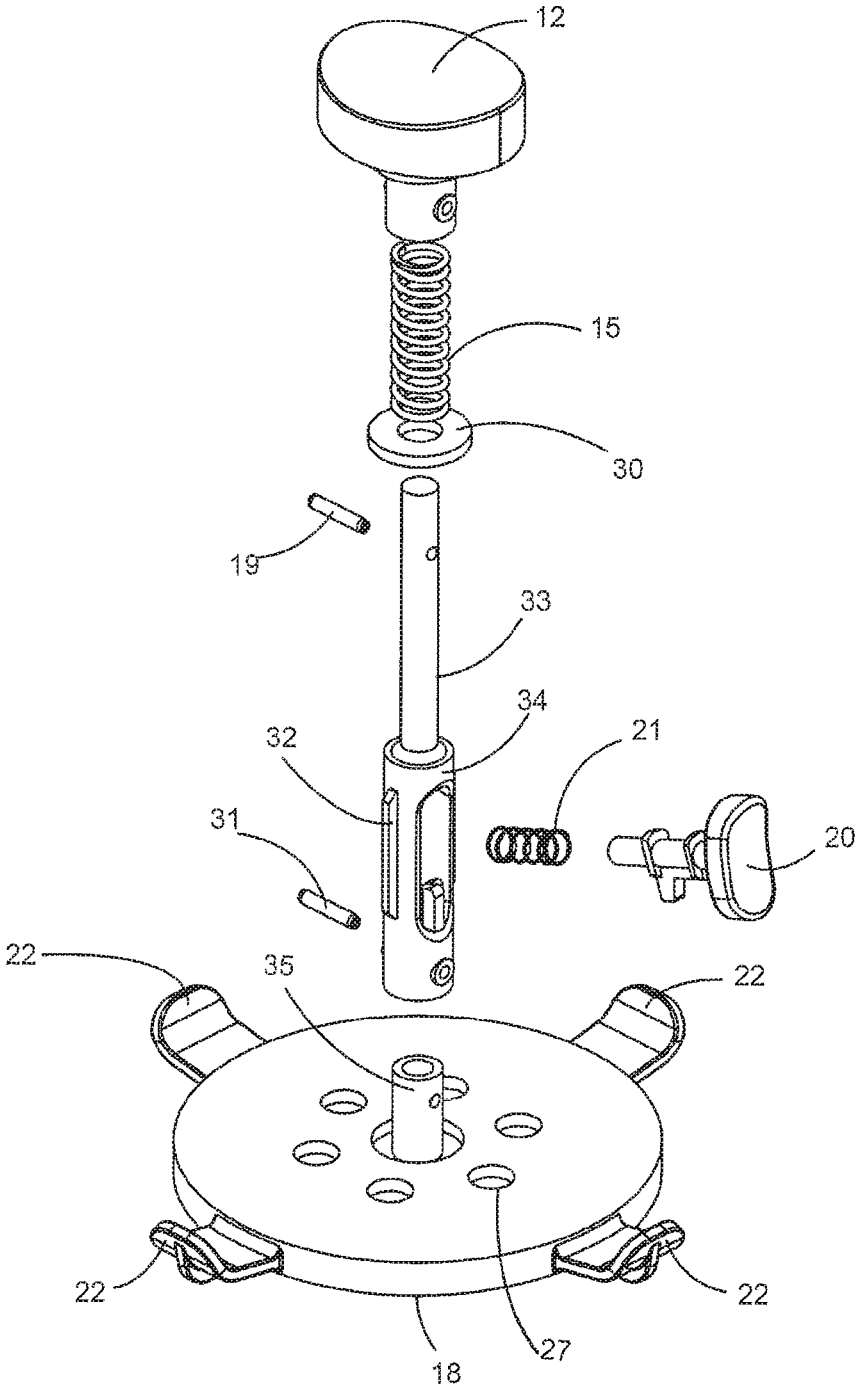
FIG. 11 is a breakaway perspective of button-shaft-flexible disk assembly of the device shown in FIG. 1.

FIG. 11 is an exploded view of device 10 showing left half 26 unscrewed from right half 36 and the central assembly comprised of actuator member 12, upper locking pin 19, spring 15, upper shaft 33, lower shaft 34, release button 20, release button spring 21, lower locking pin 31, flexible disk 18, and tabs 22. The left 26 and right 36 halves are secured to each other by four screws 24.

Figure 12:
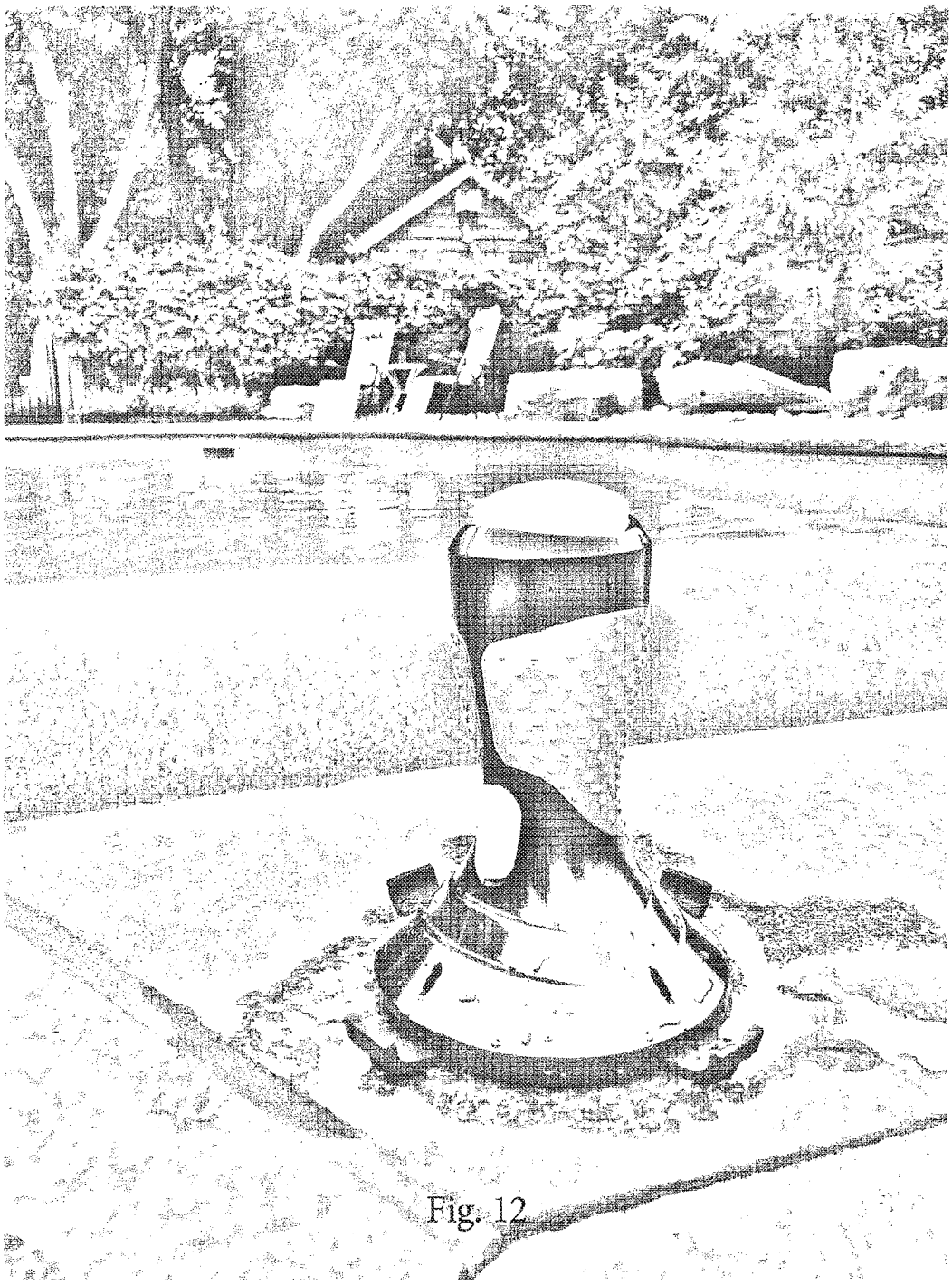
FIG. 12 is a side perspective of device 10 shown beside pool.

FIG. 12 illustrates the central part of FIG. 11 with upper locking pin 19 and lower locking pin 31 removed so as to illustrate detail of the assembly of the central part.

FIG. 13 is a perspective view of a device 10 on a coping of a swimming pool.

The present invention, therefore, is well adapted to carry out the objectives and attain the ends and advantages mentioned, as well as others inherent therein. While the invention has been depicted and described and is defined by reference to particular embodiments of the invention, such references do not imply a limitation on the invention, and no such limitation is to be inferred. Consequently, the invention is intended to be limited only by the spirit and scope of the appended claims, giving full cognizance to equivalents in all respects.

What is claimed is:

1. A device comprising a housing having an upper grab member having a height, diameter, cross-section, shape, and surface configured to be grabbed by a hand of a child or an adult, an actuator member at least partially enclosed within the upper grab member, wherein a portion of the actuator member protrudes upwards from a top of the upper grab member, the actuator member being operatively engaged with an upper shaft which is, in turn, operatively engaged with a lower shaft, the upper shaft and lower shaft together forming a shaft assembly, the actuator member being configured to move up and down within the upper grab member so as to vertically move the shaft assembly, the device further comprising a spring member within the housing arranged and adapted to urge the actuator member in an upward direction, a lower housing, a flexible disk shaped member within the lower housing, the flexible disk shaped member secured to the lower housing, a center of the flexible disk shaped member being movable by the actuator member through operative engagement of the center of the flexible disk shaped member with the shaft assembly, the device further comprising a release button accessible from a side of the device and extending at another end horizontally transversely into the housing and being urged outwardly by a release button spring when the actuator member is depressed, the release button having a protrusion configured to provide locking contact with the shaft assembly in such a way as to lock the actuator member in a down position against resistance of the spring member, thereby placing the device in prime mode wherein the flexible disk shaped member is relatively flat, the release button, when pressed inward against resistance of the release button spring, being arranged to release the actuator member by moving the protrusion out of locking contact with the shaft assembly, thereby allowing the actuator member and the center of the flexible disk shaped member to move in an upward direction to place the device in engaged mode wherein the center of the flexible disk shaped member is raised relative to its position when the device is in prime mode, the device adapted to cause the flexible disk member to engage a flat surface of a swimming pool by suction when the flexible disk shaped member is pressed against the flat surface when the device is in prime mode and then moved to engaged mode.

2. The device of claim 1 being water-proof.

3. The device of claim 1 further including one or more release tab(s) engaged with the flexible disk member.

4. The device of claim 1 configured to permit water to enter either or both of the upper grab member and lower housing without interfering with operation of the device.

5. The device of claim 1 comprising light emitting members.

6. The device of claim 1 wherein the upper grab member is semi-cylindrical.

7. The device of claim 1 wherein the lower housing has a circumference and a cross-section larger than the cross section of the upper grab member.

8. The device of claim 7 wherein flexible disk shaped member has a circumference the same as the circumference of the lower housing.

9. A kit comprising at least 2 devices according to claim 1 adapted to be easily attached by way of suction to a side or a bottom of a swimming pool, wherein each upper grab member is adapted to be grabbed by a hand of a child player or an adult player.

10. The kit of claim 9 comprising 2 to 20 devices.

11. The kit of claim 9 comprising 6 to 10 devices.

12. The device of claim 1 including a programmed member comprising a sensor and light emitting member which either flashes a signal if the upper grab member is grabbed within a predetermined time or if an upper grab member is grabbed in a predetermined sequence relative to an upper grab member of another device according to claim 1.

13. The device of claim 1 wherein the device is configured to communicate with another such device or with an external controller.

14. A kit comprising at least 2 devices according to claim 1 adapted to be easily attached by way of suction to a side or a bottom of a swimming pool, wherein each upper grab member is an elongated member adapted to be grabbed by a hand of a child player or an adult player under water and to remain attached to the side or the bottom of the swimming pool when subjected to lateral force applied to the device by the player when grabbing either device, wherein each of the devices comprises a programmed member comprising a sensor and light emitting member.

15. A kit comprising at least 2 devices according to claim 1 adapted to be easily attached by way of suction to a side or a bottom of a swimming pool, wherein each upper grab member is an elongated member adapted to be grabbed by a hand of a child player or an adult player under water and to remain attached to the one or more sides or the bottom of the swimming pool when subjected to lateral force applied to the device by the player when grabbing the device, wherein the devices are configured to communicate with each other or with an external controller.

16. The device of claim 1, wherein the release button is positioned below a portion of the upper grab member.

* * * * *